US009969065B2

(12) United States Patent
Gupte

(10) Patent No.: US 9,969,065 B2
(45) Date of Patent: May 15, 2018

(54) ONE-PIECE REMOTE WRENCH

(71) Applicant: Snap-on Incorporated, Kenosha, WI (US)

(72) Inventor: Anup A. Gupte, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 267 days.

(21) Appl. No.: 14/946,006

(22) Filed: Nov. 19, 2015

(65) Prior Publication Data

US 2016/0229046 A1 Aug. 11, 2016

Related U.S. Application Data

(60) Provisional application No. 62/114,136, filed on Feb. 10, 2015.

(51) Int. Cl.

| | |
|---|---|
| ***B25G 1/04*** | (2006.01) |
| ***B25B 13/48*** | (2006.01) |
| ***B25B 17/00*** | (2006.01) |

(52) U.S. Cl.

CPC ..... *B25B 13/481* (2013.01); *B25B 17/00* (2013.01)

(58) Field of Classification Search

CPC .... B25B 13/481; B25B 17/00; B25B 23/0021
See application file for complete search history.

(56) References Cited

U.S. PATENT DOCUMENTS

| | | | | |
|---|---|---|---|---|
| 2,678,577 | A | 5/1953 | Tackell | |
| 2,672,065 | A | 3/1954 | Danuskie | |
| 3,987,691 | A | 10/1976 | Savage | |
| 4,184,390 | A * | 1/1980 | Evans | B25B 13/467 81/57.3 |
| 4,867,016 | A | 9/1989 | Di Edwardo | |
| 5,584,220 | A | 12/1996 | Darrah et al. | |
| 5,732,605 | A | 3/1998 | Mann | |
| 6,651,532 | B1 * | 11/2003 | Whitelock | B25B 13/481 81/57.26 |
| 7,290,464 | B1 * | 11/2007 | Walter | B25B 13/467 81/177.2 |
| 7,905,162 | B2 | 3/2011 | Nguyen et al. | |
| 8,087,326 | B2 | 1/2012 | Nguyen et al. | |
| 9,440,338 | B2 * | 9/2016 | Crawford | B25B 17/00 |

(Continued)

FOREIGN PATENT DOCUMENTS

| | | | |
|---|---|---|---|
| CN | 2882909 | Y | 3/2007 |
| CN | 201841491 | U | 5/2011 |

(Continued)

OTHER PUBLICATIONS

Taiwan Office Action for Application No. 105103950 dated Jun. 9, 2017, 8 pages.

(Continued)

*Primary Examiner* — David B Thomas
(74) *Attorney, Agent, or Firm* — Seyfarth Shaw LLP

(57) ABSTRACT

A one-piece, unitary housing for a tool having apertures at both ends of the housing. The apertures can extend from the ends of the tool to a point prior to the input or output of the tool to increase structural stability. The apertures can be enclosed by flexible covers such that the internal components of the housing can be accessed by removing one or both of the covers.

29 Claims, 4 Drawing Sheets

(56) References Cited

U.S. PATENT DOCUMENTS

| | | | |
|---|---|---|---|
| 2004/0093992 | A1 | 5/2004 | Wojtynek |
| 2008/0135271 | A1 | 6/2008 | Murphy |
| 2011/0000342 | A1 | 1/2011 | Lambert |
| 2013/0032007 | A1 | 2/2013 | Chen |

FOREIGN PATENT DOCUMENTS

| | | | |
|---|---|---|---|
| DE | 102012005448 | A1 | 9/2012 |
| EP | 1086784 | A | 5/2000 |
| EP | 1086784 | A | 3/2001 |
| KR | 20020036827 | A | 5/2002 |
| TW | 430598 | | 4/2001 |
| TW | M265166 | | 5/2005 |
| TW | M356573 | | 5/2009 |
| TW | I311515 | | 7/2009 |
| TW | M419648 | | 1/2012 |
| TW | 201307012 | A | 2/2013 |
| TW | 201416183 | A | 5/2014 |

OTHER PUBLICATIONS

Brief Translation of Office Action for Application No. 105103950, 1 page.

Chinese Office Action for Application No. 201610084629.8 dated May 26, 2017, 9 pages.

United Kingdom Intellectual Property Office Combined Search and Examination Report, dated May 27, 2016;7 pages.

Australian Government Patent Examination Report No. 1, dated Apr. 7, 2016; 5 pages.

UK Intellectual Property Office Combined Search and Examination Report, dated May 10, 2017; 6 pages.

Chinese Office Action for Application No. 201610084629.8 dated Feb. 2, 2018, 8 pages.

* cited by examiner

ONE-PIECE REMOTE WRENCH

CROSS-REFERENCE TO RELATED APPLICATIONS

The present application is a non-provisional application which claims the benefit of U.S. Provisional Application No. 62/114,136, filed Feb. 10, 2015, the contents of each which are herein incorporated by reference in their entirety.

TECHNICAL FIELD OF THE INVENTION

The present invention relates generally to remote wrenches. More particularly, the present invention relates to a one-piece remote wrench housing.

BACKGROUND OF THE INVENTION

Remote or extension wrenches are commonly used to gain access to hard to access work pieces in a vehicle or other workspace. Remote wrenches include an input on a first end for receiving torque from a tool, e.g., a ratchet or torque wrench, and an output on an opposing second end for transferring the torque to the work piece (e.g., nut or bolt) in the hard to access area. The input and output are typically operably coupled by a chain-and-sprocket system or gear train to transfer the torque between the input and output, effectively connecting the tool to the work piece via the remote wrench.

Conventional remote wrenches include two-piece, clamshell housings defining a cavity, wherein the chain and sprocket system or gear train is disposed. These two pieces are then coupled together, such as with fasteners or adhesive. With such clamshell configurations, however, the remote wrench has seams dissecting the housing where the two pieces are coupled together. These seams create a weak area in the housing where the housing can fail due to torsion or torque applied between the tool and a work piece, for example, where the housing pieces separate and the tool fails. Such failure is especially common when the remote wrench is used with longer sockets and adapters that impose "off plane" loading to the housing.

SUMMARY OF THE INVENTION

In an embodiment, the present invention broadly comprises a one-piece housing for a remote wrench tool. The housing includes a unitary, one-piece body defining a cavity with apertures disposed at first and second ends. The apertures can be removably covered to allow access to the cavity, such that a sprocket system or gear train can be disposed therein and maintained, when needed. The apertures can extend from the sides and, in some embodiments, not extend beyond the input or output of the remote wrench. Accordingly, the structural stability of the apertures is not compromised by torsion induced by the input and output of the remote wrench. In some embodiments, the apertures are enclosed by a removable cover to allow further access to the internal components disposed in the cavity.

The one-piece, unitary housing eliminates seams inherent with two-piece clamshell housings, thus improving structural stability. By implementing a unitary, one-piece body construction where the apertures do not extend past the input and output of the remote wrench, the housing of the present invention eliminates the seams of conventional tool housings while still allowing access to the internal components of the tool. For example, the internal components can be assembled into the tool through the apertures located at the ends of the housing.

In another embodiment, the present invention broadly comprises a tool including a one-piece housing having opposing first and second ends, and first and second end apertures respectively defined in the housing at the first and second ends and adapted to allow for insertion of components of the tool to be housed within the housing. An input is rotatably coupled to the housing and is adapted to receive torque from a tool, such as a ratchet or other wrench. An output is also rotatably coupled to the housing and adapted to receive torque from the input and transfer the torque to a work piece, such as with a removably coupled socket. The first and second end apertures extend from the ends to a point respectively before the input and output.

In yet another embodiment, the present invention broadly comprises a method of assembling a tool including providing a housing having opposing first and second end apertures, inserting an input into one of the first and second end apertures, inserting an output into one of the first and second end apertures, and coupling the input to the output.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
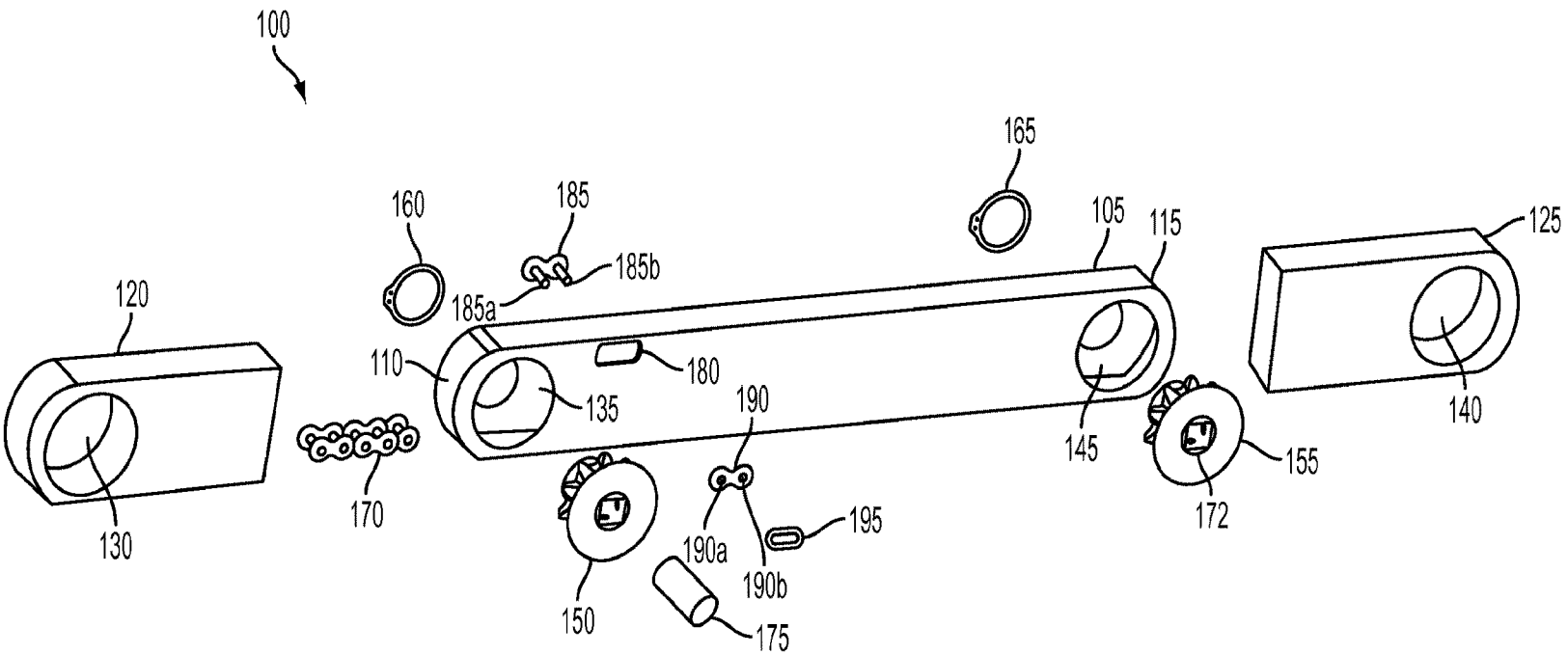
FIG. 1 is an exploded, perspective view of a remote wrench according to an embodiment of the present invention.
Figure 2A:
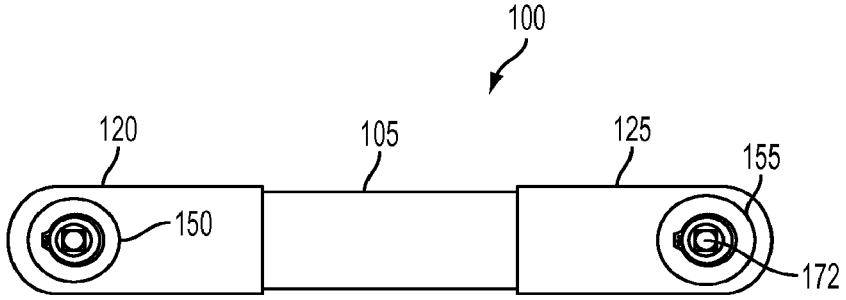
FIG. 2A is a top plan view of a remote wrench according to an embodiment of the present invention.
Figure 2B:
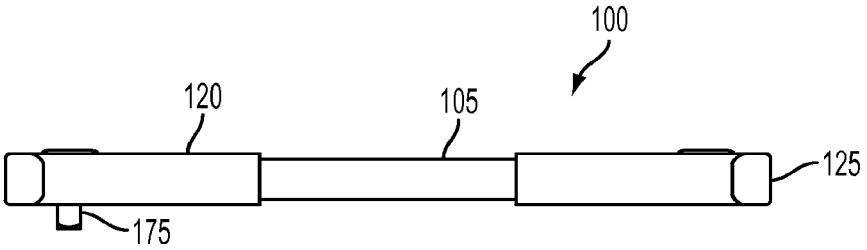
FIG. 2B is a side elevation view of the remote wrench of FIG. 2A.
Figure 2C:
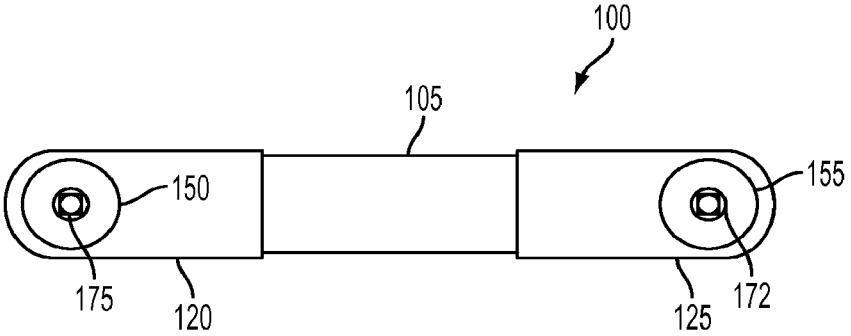
FIG. 2C is a bottom plan view of the remote wrench of FIG. 2A.
Figure 3:
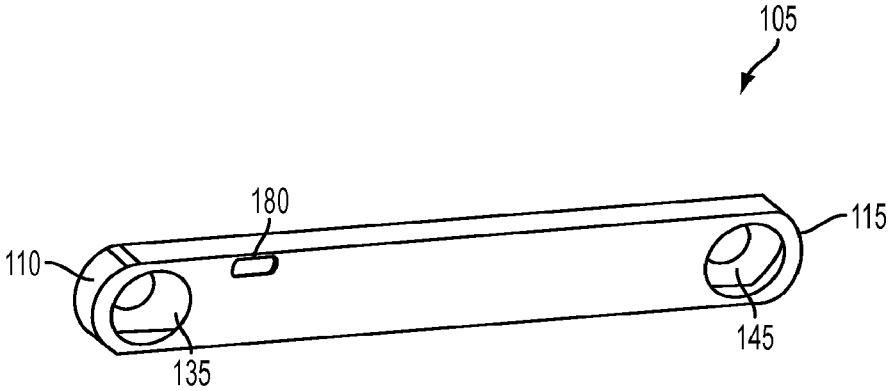
FIG. 3 is a perspective side view of a housing according to an embodiment of the present invention.
Figure 4:
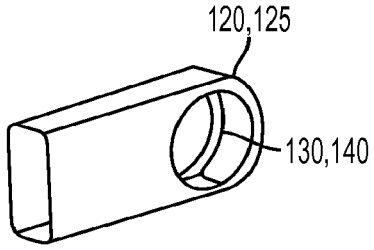
FIG. 4 is a perspective side view of a housing end cover according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

In an embodiment, the present invention broadly comprises a housing for a tool, for example a remote or extension wrench. The housing defines a cavity therein and is constructed of a one-piece, unitary body having apertures at opposing first and second ends to allow access to cavity. In an embodiment, the openings do not extend past the input or output of the tool, increasing the structural stability of the tool. The apertures can be enclosed by a removable cover, such as an elastomeric cover or rubberized cover, to allow access to the cavity by removing one or both of the covers.

The one-piece, unitary housing of the present invention eliminates seams caused by conventional clam shell housings coupled together. The housing of the present invention also allows access to the cavity by implementing easy to remove covers to enclose the apertures rather than requiring the use of a tool to remove fasteners that couple the tool housing together with a conventional clamshell configuration. These apertures allow access to the housing to, for example, assemble the internal components into the housing, or repair or maintain the internal components after assembly. The apertures can also extend from the sides of the tool, but not beyond the input or output of the tool, to increase structural stability and avoid the stresses caused by the input and output during use.

Referring to FIGS. 1-4, an embodiment of the present invention broadly comprises a remote wrench 100 that includes a housing 105 having a first end aperture 110 disposed at a first end of the housing 105, and a second end aperture 115 disposed at an opposing second end of the housing 105. The first and second end apertures 110, 115 may be covered with respective first and second covers 120, 125. The first and second end apertures 110, 115 allow access to a cavity defined within the housing 105, which houses the components necessary for the remote wrench to operate, such as, for example, a chain-and-sprocket or gear train system. The housing 105 is preferably unitary, i.e., constructed of a single piece, rather than comprised of multiple or clam-shell components coupled together by fasteners or other means. In doing so, the housing 105 is resistant to failure due to torsion or torque because the housing 105 lacks seams or other weak areas that conventional clamshell housings include. In an embodiment, the housing 105 can be constructed of metal, reinforced glass, or other material. Also, the first and second end apertures 110, 115 allow access to the cavity disposed in the housing 105.

In an embodiment, the first cover 120 includes a first cover opening 130 that substantially axially aligns with a first side opening 135 of the housing 105 when the first cover 120 is releasably coupled to the housing 105, such as with a friction-fit. Similarly, the second cover 125 includes a second cover opening 140 that substantially axially aligns with a second side opening 145 of the housing 105 when the second cover 125 is releasably coupled to the housing 105, such as with a friction-fit. Together, these side openings 135, 145 and cover openings 130, 140 provide insertion and access locations for respective output 150 and input 155 to be installed into the housing 105. More particularly, the output 150 can be axially inserted into the first side opening 135 and held in place with a first clip 160, and the input 155 is axially inserted into the second side opening 145 and held in place by a second clip 165. The output and input 150, 155 are rotatable relative to the housing 105.

The input 155 is operably coupled with the output 150 to facilitate transfer of torque applied to the input 155 to the output 150. For example, in an embodiment, the input and output 155, 150 each includes circumferentially disposed gear teeth on its outer circumference, thereby respectively defining first and second sprockets. A chain 170 can operably couple the input and output 155, 150 by being disposed inside of the housing cavity and around the outer peripheries of the input and output 155, 150 to meshingly engage the first and second sprockets, similar to a bicycle transferring torque from its pedals to the wheels of the bicycle. Alternately, or in addition to the above, the input and output 155, 150 can be operably coupled with a gear train, for example, an in-line gear train operatively coupling the input and output 155. It will be appreciated that the input and output 155, 150 can be operably coupled to transfer torque therebetween in any known manner without departing from the scope and spirit of the present invention.

In an embodiment, one or both of the input 155 and output 150 includes a receiving portion 172 adapted to cooperatively engage a lug of a tool in a well-known means. In this manner, the input 155 functions as an input mechanism for the tool 100 and receives torque from, for example, a torque or ratchet wrench or other suitable tool. For example, a user can insert a lug of a torque or ratchet wrench or other suitable tool into the receiving portion 172 disposed within the input 155.

In an embodiment, either one or both of the output 150 or input 155 can include an output lug 175, similar in shape and size to the lug driver of a torque wrench or other tool (e.g., ¼", ⅜" or ½"), which can be releasably coupled to an accessory (such as a socket) that is adapted to be engage with and apply torque to a work piece. The output lug 175 can be permanently or releasably couplable to the input 155 and output 150, and inserted into either or both of the input and output 155, 150, in some embodiments. Similarly, the input 155 can include a lug so a crescent or open box wrench can engage the input 155 and cause rotation of the input 155 and output 150. As discussed herein, the receiving portion 172 can be referred to as an input of the tool 100, and the driver 175 can be referred to as an output of the tool 100.

As shown, in some embodiments, the first and second end apertures 110, 115 respectively extend from the ends of the tool 100, but do not extend past the input or output of the tool 100. For example, the first 110 and second 115 end apertures can respectively extend from the ends of the tool 100 to points respectively before the receiving portion 172 or the driver 175. In this configuration, the first 110 and second 115 end apertures allow for a structurally stable housing 105 by allowing greater material surrounding the point of greatest torsion within the housing 105, the input 155 and output 150. At the same time, the tool 100 can include a one-piece housing that allows insertion of the components at the axial ends of the tool 100, which resists overall torsion stresses in the tool 100 by eliminating seams in the housing 105.

In another embodiment, the housing 105 can include a side hole 180 for another access point to the cavity. For example, the housing 105 can include a front surface, rear surface, top surface, and bottom surface, and the side hole 180 can be defined within the front and rear surfaces. The side hole 180 can include first and second side holes respectively defined on first and second sides of the tool 100. To gain access to the side hole 180 and access the internal components of the housing 105, the user need only remove the cover 120 that covers the side hole 180. For example, as shown in FIG. 1, the side hole 180 is positioned in such a way to allow access to the cavity and can be enclosed by a combination of a male plate 185, female plate 190, and clip 195. The male plate 185 can include prongs or other protrusions receivable by the female plate 190 on an opposite side of the tool 100. For example, the male plate 185 can be disposed on a rear side of the tool 100, and the female plate 190 can be disposed on an opposite front side of the tool 100. The clip 195 can then couple to the prongs, or to other male components, to retain the female plate 190 against the side hole 180. In this manner, the side hole 180 can be removably enclosed by the combination of the male plate 185, female plate 190, and clip 195.

As discussed above, the first end opening 110 and second end opening 115 allow access to the internal components of the tool 100 and further allow the internal components to be assembled into the tool 100. For example, the chain 170 or gear train can be inserted by removing either of the covers 120, 125 prior to inserting the output 155 and input 150 and inserting the chain 170 into the housing 105 through either end apertures 110, 115. Subsequently, or prior to the insertion of the chain 170, the output and input 150, 155 can be inserted through the side openings 135, 145 and coupled in place by the clips 160, 165.

As discussed above, the tool 100 can be a remote wrench. However, the housing 105 can be employed in any tool 100 or object, such as a remote wrench, impact wrench, torque wrench, or other suitable object. The tool 100 need not be a tool at all, and can instead be a piece of sporting equipment, industrial equipment, office equipment, or other type of object that requires a housing.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the following claims when viewed in their proper perspective based on the prior art.

What is claimed is:

1. A tool extension having an opposing input and output extending through a cavity and operably coupled with a mechanism to transmit torque therebetween, comprising:

a housing defining the cavity and having opposing first and second ends with respective first and second end apertures;

first and second side openings defined by the housing that are adapted to respectively receive the input and output;

a first cover releasably coupled to the first end of the housing and covering the first end aperture, the first cover includes a first cover opening that substantially axially aligns with the first side opening; and a second cover releasably coupled to the second end of the housing and covering the second end aperture, the second cover includes a second cover opening that substantially axially aligns with the second side opening.

2. The tool extension of claim 1, wherein the housing includes top, bottom, rear and front surfaces, and further comprising first and second side holes respectively defined on the rear and front surfaces.

3. The tool extension of claim 2, further comprising a male plate coupled to the second side hole, and a female plate coupled to the male plate proximate the first side hole.

4. The tool extension of claim 3, further comprising a clip coupled to the male plate that retains the female plate proximate to the first side hole.

5. A tool extension, comprising:

a housing defining a cavity and having opposing first and second ends with respective first and second end apertures;

first and second side openings defined within the housing;

an input and output respectively disposed in the first and second side openings that extend through the cavity and are operably coupled together with a mechanism to transmit torque therebetween;

a first cover releasably coupled to the first end of the housing and covering the first end aperture, the first cover includes a first cover opening that substantially axially aligns with the first side opening; and a second cover releasably coupled to the second end of the housing and covering the second end aperture, the second cover includes a second cover opening that substantially axially aligns with the second side opening.

6. The tool extension of claim 5, wherein the input and output respectively include first and second sprockets and the mechanism includes a chain disposed in the cavity that meshingly engages the first and second sprockets.

7. The tool extension of claim 5, wherein the input and output respectively include first and second sprockets and the mechanism includes a gear train.

8. The tool extension of claim 5, wherein the input includes a receiving portion.

9. The tool extension of claim 5, wherein the output includes a lug.

10. The tool extension of claim 5, wherein each of the first and second covers is composed of a cover material and the housing is composed of a housing material, and wherein the cover material is more flexible than the housing material.

11. A method of assembling a tool extension having an opposing input and output operably coupled together with a mechanism that is adapted to transmit torque therebetween, comprising:

providing a housing defining a cavity and having opposing first and second ends with respective first and second end apertures respectively defined in the housing at the first and second ends, and further having first and second side openings defined by a side of the housing;

releasably coupling a first cover to the first end of the housing, the first cover includes a first cover opening that substantially axially aligns with the first side opening;

releasably coupling a second cover to the second end of the housing, the second cover includes a second cover opening that substantially axially aligns with the second side opening;

respectively axially inserting the input and output into the first and second side openings; and inserting the mechanism into the cavity at the first or second end aperture.

12. The method of claim 11, further comprising providing a side hole in the housing, and coupling a male plate to a female plate to enclose the side hole.

13. The method of claim 12, further comprising providing a clip, wherein the clip retains the male and female plates against the housing.

14. A tool extension having an opposing input and output operably coupled with a mechanism to transmit torque therebetween, comprising:

a housing having rear and front surfaces, the housing defining a cavity and having opposing first and second ends and first and second end apertures respectively defined in the housing at the first and second ends;

first and second side openings defined by the housing and adapted to respectively receive the input and output; and first and second side holes respectively defined on the rear and front surfaces and adapted to allow access to the cavity.

15. The tool extension of claim 14, further comprising a male plate coupled to the second side hole, and a female plate coupling to the male plate proximate the first side hole.

16. The tool extension of claim 15, further comprising a clip coupled to the male plate and retaining the female plate proximate to the first side hole.

17. The tool extension of claim 14, wherein the first and second end apertures respectively extend from the first and second ends towards the respective input and output.

18. A tool extension, comprising:

a housing having rear and front surfaces, the housing defining a cavity and having opposing first and second ends with respective first and second end apertures;

first and second side openings defined within the housing;

an input and output respectively disposed in the first and second side openings, extending through the cavity, and operably coupled together with a mechanism to transmit torque therebetween; and first and second side holes respectively defined on the rear and front surfaces and adapted to allow access to the cavity.

19. The tool extension of claim 18, wherein the input and output respectively include first and second sprockets and the mechanism includes a chain disposed in the cavity that meshingly engages the first and second sprockets.

20. The tool extension of claim 18, wherein the input and output respectively include first and second sprockets and the mechanism includes a gear train.

21. The tool extension of claim 18, wherein the input includes a receiving portion.

22. The tool extension of claim 18, wherein the output includes a lug.

23. The tool extension of claim 18, further comprising a first cover that covers the first end aperture.

24. The tool extension of claim 23, further comprising a second cover that covers the second end aperture.

25. The tool extension of claim 24, wherein the cover is composed of a cover material and the housing is composed of a housing material, and wherein the cover material is more flexible than the housing material.

26. The tool extension of claim 18, wherein the first and second end apertures respectively extend from the first and second ends towards the respective input and output.

27. A method of assembling a tool extension having an opposing input and output operably coupled together with a mechanism to transmit torque therebetween, comprising:

providing a housing having rear and front surfaces, the housing defining a cavity and having opposing first and second ends with respective first and second end apertures, and further having first and second side openings defined by a side of the housing, and first and second side holes respectively defined on the rear and front surfaces and adapted to allow access to the cavity;

respectively axially inserting the input and output into at least one of the first and second side openings; and inserting the mechanism into the cavity at the first or second end aperture.

28. The method of claim 27, further comprising coupling a male plate to a female plate to enclose the first and second side holes.

29. The method of claim 28, further comprising providing a clip, and retaining the male and female plate against the housing with the clip.

* * * * *